US005988040A

United States Patent [19]

Ota et al.

[11] Patent Number: 5,988,040

[45] Date of Patent: Nov. 23, 1999

[54] VARIABLE DISPLACEMENT SWASH PLATE COMPRESSOR WITH IMPROVED SWASH PLATE SUPPORT MEANS

[75] Inventors: Masaki Ota; Shigeyuki Hidaka; Hisakazu Kobayashi; Youichi Okadome, all of Kariya, Japan

[73] Assignee: Kabushiki Kaisha Toyoda Jidoshokki Seisakusho, Kariya, Japan

[21] Appl. No.: 08/945,137

[22] PCT Filed: Jan. 24, 1997

[86] PCT No.: PCT/JP97/00163

§ 371 Date: Oct. 15, 1997

§ 102(e) Date: Oct. 15, 1997

[87] PCT Pub. No.: WO98/32969

PCT Pub. Date: Jul. 30, 1998

[51] Int. Cl.[6] ..... F04B 1/26

[52] U.S. Cl. ..... 92/12.2; 91/505

[58] Field of Search ..... 92/12.2; 91/505; 417/222.2

[56] References Cited

U.S. PATENT DOCUMENTS

| | | | |
|---|---|---|---|
| 4,842,488 | 6/1989 | Terauchi | 417/222.2 |
| 4,846,049 | 7/1989 | Terauchi | 92/12.2 |
| 5,259,736 | 11/1993 | Terauchi | 417/222.1 |
| 5,540,559 | 7/1996 | Kimura et al. | 92/12.2 |
| 5,713,725 | 2/1998 | Kawaguchi et al. | 417/222.2 |
| 5,882,179 | 3/1999 | Ota et al. | 417/222.2 |

FOREIGN PATENT DOCUMENTS

| | | |
|---|---|---|
| 62-87678 | 4/1987 | Japan . |
| 6-288347 | 11/1994 | Japan . |

*Primary Examiner*—John Ryznic
*Attorney, Agent, or Firm*—Burgess, Ryan & Wayne

[57] ABSTRACT

A variable displacement swash plate type compressor including a sleeve member (18) placed on a drive shaft (6) between a through-bore (20) formed in a swash plate (11) and a drive shaft (6) so as to move along the axis of the drive shaft (6) in response to a movement of the swash plate (11) for changing its angle of inclination. The swash plate (11) is provided with a support portion (20*a*) to be locally in contact with the sleeve (18) in a portion of an inner surface defining the through-bore (20), opposite a hinge mechanism (K) with respect to the axis of the drive shaft (6), and the angle of inclination of the swash plate supported by the support portion (20*a*) can be changed in a controlled range, and thus, a range of sliding movement of the support portion (20*a*) of the inner surface defining the through-bore (20) of the swash plate (11) relative to the sleeve (18) is reduced to suppress abrasion of the sleeve (18) and the support portion (20*a*), and to ensure a smooth inclination-angle changing operation of the swash plate (11). The through-bore (20) of the swash plate (11) has an inner surface (20*b*) which comes into contact with the outer circumference of the sleeve (18) to determine the minimum angle of inclination of the swash plate (11).

9 Claims, 10 Drawing Sheets

VARIABLE DISPLACEMENT SWASH PLATE COMPRESSOR WITH IMPROVED SWASH PLATE SUPPORT MEANS

TECHNICAL FIELD

The present invention relates to a variable displacement swash plate compressor intended for use in a climate control system for a vehicle and, more particularly, to an improved structure which enables smooth movement of a swash plate capable of changing its angle of inclination with respect to a plane perpendicular to the axis of a rotational drive shaft of the compressor, as well as axial movement of the swash plate, by a simple swash plate support means.

RELATED ART

Many compressors have been proposed in which the discharge capacity of a compressor is adjustably varied by changing the stroke of the pistons thereof due to a change in an angular displacement of a swash plate (including a combined assembly of a rotating swash plate and a non-rotatable wobble plate). For example, a variable displacement swash plate compressor disclosed in Japanese Unexamined (Kokai) patent publication No. 62-87678 is designed to simplify a swash plate support mechanism. As shown in FIG. 11, in this previously proposed variable displacement swash plate type compressor, a swash plate 45 is disposed in a crank chamber 42. A drive shaft 43 is extended through the swash plate 45 via a boss 52 thereof in a manner such that the boss is provided with a bore 55 formed therein to have a wall surface capable of coming into partial contact with the drive shaft to thereby determine a radial position of the swash plate 45, and allow the angle of inclination of the swash plate to change. Thus, sliders and pivotal pins, which are essential components of the conventional variable displacement swash plate compressors, can be omitted. The swash plate 45 is guided for movement along a fixed path of displacement by the drive shaft 43 in partial contact with a lower curved surface 55*b* of the bore 55 of the swash plate 45.

In the described prior art compressor, a moment produced by a reaction force resulting from the exertion of a compressing force acting on the swash plate 45 in the direction of inclination is borne by a support mechanism including an elongated slot 53 and a pin 53*a,* and the lower curved surface 55*b* in contact with the drive shaft 43. Therefore, when the angle of inclination of the swash plate 45 is changed, the curved surface 55*b* in linear contact with the drive shaft 43 slides under a load in a predetermined section of the drive shaft 43. A moment produced by a reaction force resulting from the exertion of a compressing force acts in a direction perpendicular to the direction of inclination of the swash plate 45 owing to the structural condition of the swash plate 45, and this moment is born by a portion of a small diameter of a long bore serving as the bore 55. When the inclination of the swash plate 45 is changed, the edges of diagonally opposite portions of a small diameter at the front and the rear ends of the bore 55 come into linear sliding contact with the drive shaft 43.

Furthermore, the moment bearing ability of the single support mechanism for supporting the swash plate 45 of the prior art compressor disposed in the crank chamber 42 is very low as compared with that of a duplex support mechanism such as disclosed in, for example, Japanese Unexamined (Kokai) patent publication No. 6-288347 consisting of a pair of support mechanisms disposed respectively on the opposite sides of the drive shaft, and a pressure acting on the surface in sliding contact with the drive shaft 3 necessarily increases. Accordingly, local abrasion develops in the drive shaft and the surface defining the bore 55 if the surface defining the bore 55 and in linear contact with the shaft 43 slides repeatedly through a relatively long distance, so that accurate, smooth variation of the angle of inclination of the swash plate 5 cannot be achieved.

Although not described in the afore-mentioned Japanese Unexamined (Kokai) patent publication No. 62-87678, it is very difficult to hold the swash plate of the variable displacement swash plate compressor accurately at a minimum angle of inclination. Therefore, if the minimum angle of inclination is excessively small, faulty oil return from a refrigerating circuit to the compressor occurs to deteriorate the reliability of the refrigerating circuit of the climate control system. If the minimum inclination is excessively large, the minimum displacement of the compressor is excessively large, so that other problems, such as the excessive cooling of an air conditioned space and frosting of the evaporator of the refrigerating circuit of the climate control system arise.

DISCLOSURE OF THE INVENTION

Accordingly, a principal object of the present invention is to eliminate drawbacks encountered by the conventional variable displacement swash plate type compressors.

Another object of the present invention is to provide a variable displacement swash plate type compressor provided with a swash plate support means having an internal mechanism of an improved design, and capable of ensuring smooth displacement of a swash plate and of extending the life of the swash plate and the drive shaft.

A further object of the present invention is to provide a variable displacement swash plate type compressor provided with a swash plate support means capable of improving the accuracy of setting a swash plate at a minimum inclination in a crank chamber without introducing difficulties in mounting the swash plate in the crank chamber.

Still a further object of the present invention is to provide a variable displacement swash plate type compressor provided with a swash plate support means capable of being manufactured at the least possible manufacturing cost.

In accordance with one aspect of the present invention, there is provided a variable displacement swash plate type compressor which includes:

a cylinder block provided with a plurality of parallel cylinder bores which forms an outer framework of the compressor;

a front housing defining therein a crank chamber and sealingly connected to the cylinder block so as to close an open front end of the cylinder block;

a drive shaft rotatably supported on the cylinder block and the front housing to have an axis thereof about which the drive shaft is able to be rotated;

a rotor fixedly mounted on the drive shaft within the crank chamber;

a rear housing having a suction chamber and a discharge chamber formed therein, and sealingly connected to the cylinder block so as to close an open rear end of the cylinder block;

a swash plate mounted on the drive shaft so that an angle of inclination thereof can be changed, and connected to the rotor via a hinge mechanism; and pistons fitted for linear motions in the cylinder bores and engaged with the swash plate;

wherein the swash plate has a through-bore formed therein, and a sleeve member is arranged between an inner wall of the through-bore and the drive shaft so as to axially move on the drive shaft in response to a change in an angle of inclination of the swash plate, the swash plate including a support portion thereof formed in an inner surface defining the through-bore at a portion thereof which is located opposite to the hinge mechanism with respect to the axis of the drive shaft, the support member being capable of coming into a local contact with the sleeve member, and the angle of inclination of the swash plate supported by the support portion being able to be changed in a controlled range.

Preferably, the through-bore of the swash plate includes two continuous bore sections allowing the swash plate to change its angle of inclination toward axially opposite directions with respect to the support portion, the two continuous bore sections of the through-bore being defined by two inner surface portions having different inner diameters.

Preferably, the swash plate is provided with an abutting portion formed at a position thereof arranged adjacent to one end of the through-bore so as to be brought into contact with a flange formed on the sleeve member, the abutting portion being formed in a shape such that the axial distance between the support portion and the abutting portion remains substantially unchanged regardless of the inclination of the swash plate.

Preferably, one of the two different inner surface portions defining the two bore sections of the through-bore is brought into contact with the sleeve member to result in determination of the minimum angle of inclination of the swash plate.

BRIEF DESCRIPTION OF THE DRAWINGS

The above and other objects, features and advantages of the present invention will be made apparent from the ensuing description of preferred embodiments with reference to the accompanying drawings wherein.

It should be noted that in the drawings like or corresponding elements are designated by the same reference characters.

BEST MODE OF CARRYING OUT THE INVENTION

Figure 1:
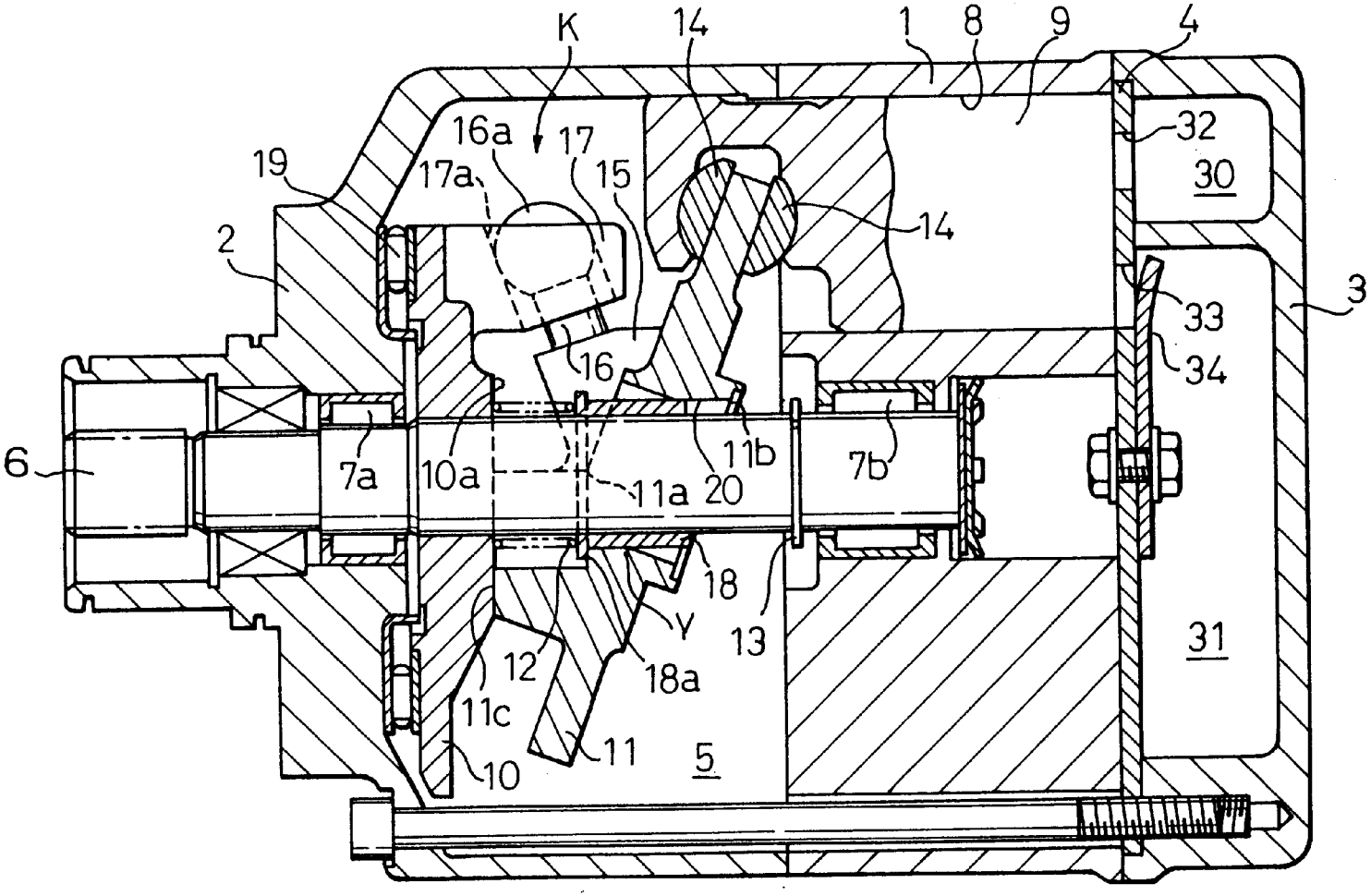
FIG. 1 is a longitudinal sectional view of a variable displacement swash plate type compressor according to a first embodiment of the present invention.

Referring to FIG. 1, a variable displacement swash plate type compressor according to a first embodiment of the present invention includes a cylinder block 1, a front housing 2 hermetically joined to the front end of the cylinder block 1, and a rear housing 3 hermetically joined to the rear end of the cylinder block 1 with a valve plate 4 held between the rear end of the cylinder block 1 and the rear housing 3. A drive shaft 6 having a longitudinal axis is disposed in a crank chamber 5 defined by the cylinder block 1 and the front housing 2, and is supported to be rotated about its axis of rotation by anti-friction bearings 7*a* and 7*b*. The cylinder block 1 is provided with a plurality of cylinder bores 8 arranged at angular intervals around the drive shaft 6. Reciprocatory pistons 9 are slidably fitted in the cylinder bores 8, respectively.

In the crank chamber 5, a rotor 10 is fixedly mounted on the drive shaft 6, a suitable bearing 19 is interposed between the rotor 10 and the front housing 2, and a swash plate 11 provided with a through-bore 20 is mounted on a portion of the drive shaft 6 behind the rotor 10 with the drive shaft 6 extended through the through-bore 20. A sleeve 18 is interposed between the inner bore surface of the through-bore 20 and the drive shaft 6. The sleeve 18 forms a swash plate support means for supporting the swash plate 11 in combination with a hinge mechanism, which will be described later.

Figure 4:
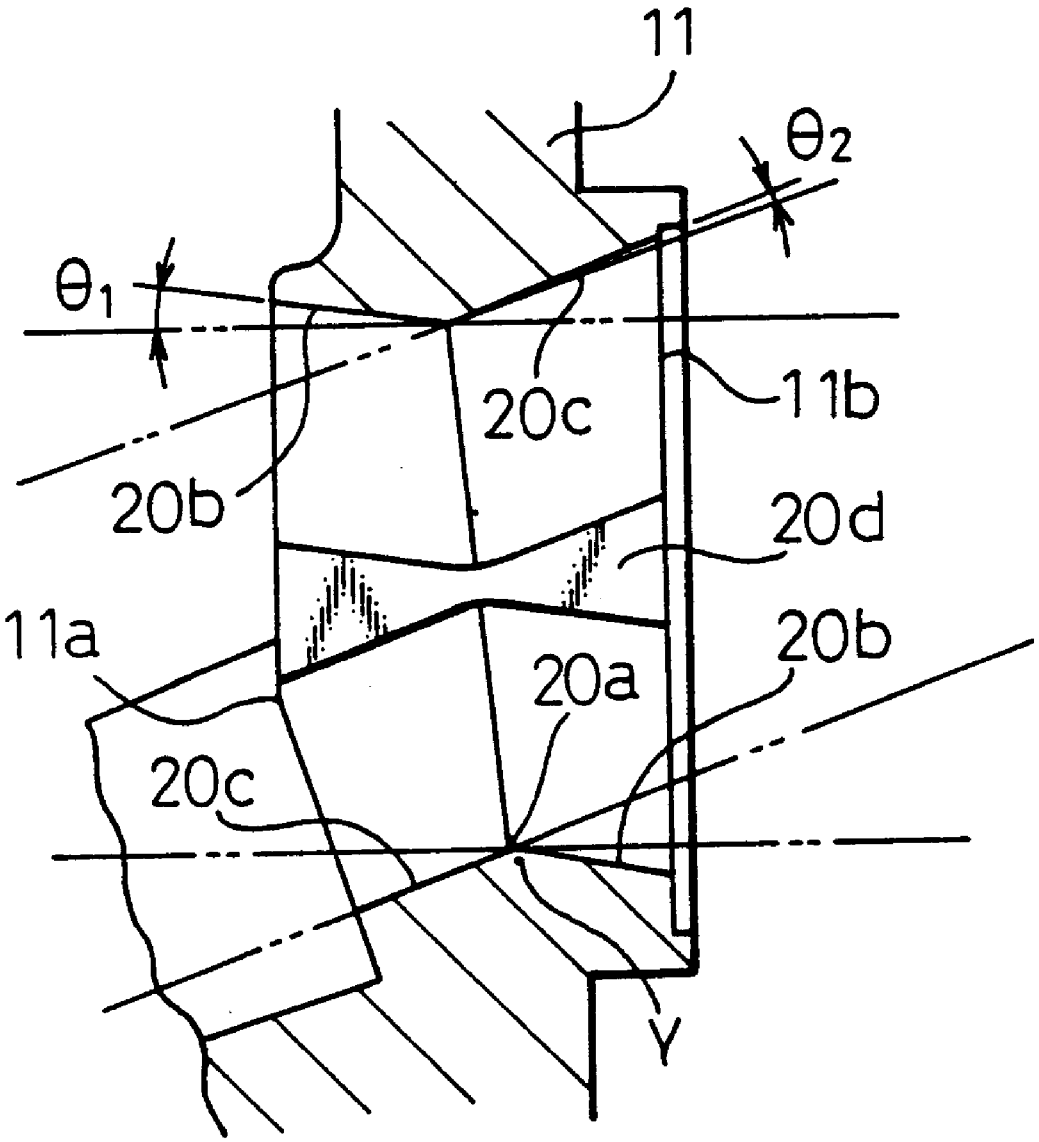
FIG. 4 is an enlarged sectional view of an important internal construction of a swash plate shown in FIGS. 2 and 3.

The through-bore 20 of the swash plate 11 has the shape of an elongate bent hole which allows the swash plate 11 to turn about a pivotal axis Y extending in a swash plate region outside the sleeve 18 on a side opposite the hinge mechanism K with respect to the longitudinal axis of the drive shaft 6 to change its angle of inclination from a plane perpendicular to the axis of the drive shaft 6 in an entire controlled range. As best shown in FIG. 4, the inner surface of the through-bore 20 is locally in contact with the outer circumference of the sleeve 18 to determine the radial position of the swash plate 11. More specifically, a support portion 20*a* having the shape of a small circular arc having its center on the pivotal axis "Y" is formed to determine the radial position of the swash plate 11 in a plane including the axis of the drive shaft 6 and the top dead center of the swash plate 11. An inner surface 20*b* of the curved through-bore 20 on the side of a minimum inclination angle is formed with a margin angle $\theta_1$ in the range of 10° through 15°, and an inner circumference 20*c* of the curved through-bore 20 on the side of a maximum inclination angle is formed with a margin angle $\theta_2$ in the range of 1° to 2° to ensure changing the angle of inclination of the swash plate 11 between a minimum inclination angle and a maximum inclination angle. Flat inner surfaces 20*d* are created necessarily in opposite end portions of the through-bore 20 of the swash plate 11 when the elongate curved hole is formed by machining. The flat inner surfaces 20*d* suppress any undesirable play of the swash plate 11.

The sleeve 18 is provided at its front end with a flange 18*a*. A coil spring 12 is extended between the rotor 10 and the sleeve 18 to bias the sleeve 18 elastically rearward to keep the flange 18*a* in contact with an abutting portion 11*a* of the front end surface of the swash plate 11, so that the sleeve 18 is shifted on the drive shaft 6 according to the variation of the inclination of the swash plate 11.

As shown in FIG. 1, hemispherical shoes 14, i.e., components of a coupling mechanism, are put on the periphery of the swash plate 11, the hemispherical surfaces of the shoes 14 are in engagement with spherical bearing surfaces formed in the pistons 9. The plurality of pistons 9 thus engaged with the swash plate 11 are axially slidably fitted for reciprocation in the respective cylinder bores 8.

A bracket 15, i.e., one of the components of the hinge mechanism K, projects from the front surface of the swash plate 11. A guide pin 16 has a base end fixed to the bracket 15 and a free end provided with a ball 16*a*. A support arm 17, i.e., another component of the hinge mechanism K, projects in parallel to the axis of the drive shaft 6 from an upper portion of the rear surface of the rotor 10 so as to lie opposite to the guide pin 16. A guide hole 17*a* is formed through a free end portion of the support arm 17 so as to extend obliquely rearward and toward the axis of the drive shaft 6 in parallel to a plane defined by the axis of the drive shaft 6 and the top dead center of the swash plate 11. The center axis of the thus inclined guide hole 17*a* is determined so that the top dead center of each piston 9 does not substantially change while the angle of inclination of the swash plate, restrained from free movement by the ball 16*a* fitted in the guide hole 17*a*, is being changed.

A space in the rear housing 3 is partitioned into a suction chamber 30 and a discharge chamber 31. The valve plate 4 is provided with suction ports 32 and discharge ports 33 corresponding to the cylinder bores 8, respectively. A compression chamber formed between the valve plate 4 and each piston 9 communicates with the suction chamber 30 and the discharge chamber 31 by means of the corresponding suction port 32 and the corresponding discharge port 33, respectively. Each suction port 32 is provided with a suction valve, not shown, of a known construction for opening and closing each suction port 32 according to the reciprocating action of the piston 9, and each discharge port 33 is provided with a discharge valve, not shown, of a known construction for opening and closing the discharge port 33 in response to the reciprocating action of the piston 9. The opening stroke of the discharge valve is limited by a retainer 34. The rear housing 3 is provided with a control valve, not shown, for regulating the pressure of the crank chamber 5.

The variable displacement swash plate type compressor thus constructed starts its refrigerant compressing operation when the drive shaft 6 is driven for rotation by an external force. The swash plate 11 is rotated together with the drive shaft 6 by the rotor 10 and, consequently, the pistons 9 are driven for reciprocation in the corresponding cylinder bores 8 through the shoes 14 to suck a refrigerant gas from the suction chamber 30 into the compression chamber, to compress the refrigerant gas and to discharge the compressed refrigerant gas into the discharge chamber 31. The discharge of the refrigerant gas from the cylinder bores 8 into the discharge chamber 31 is controlled by the control valve through regulating a pressure prevailing in the crank chamber 5.

Figure 2:
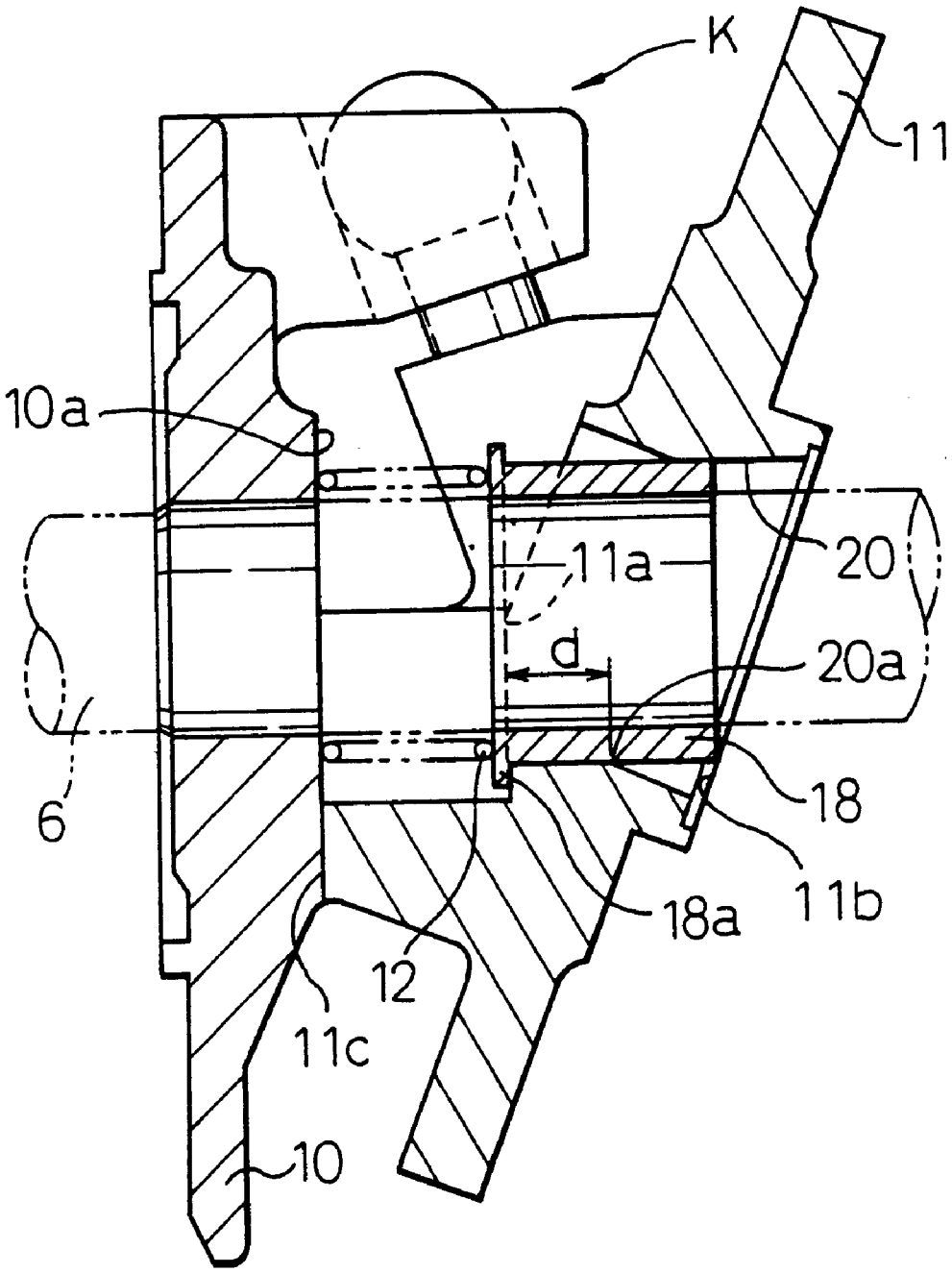
FIG. 2 is a cross-sectional view of an essential portion of the compressor of FIG. 1, illustrating a swash plate support means, in which a swash plate is set at a maximum inclination-angle position.

If the control valve is operated to increase the pressure of the crank chamber 5 in a state shown in FIG. 2, back pressure acting on the pistons 9 increases and the angle of inclination of the swash plate 11 decreases. Consequently, the ball 16*a* of the guide pin 16 of the hinge mechanism K turns counterclockwise in the guide hole 17*a* and slides along the guide hole 17*a* toward the axis of the drive shaft 6, and the support portion 20*a* having the shape of a circular arc of the swash plate 11 turns about the pivotal axis Y on the sleeve 18, i.e., a component of the swash plate support means, and moves rearward in parallel to the axis of the drive shaft 6. Thus, the angle of inclination of the swash plate 11 in the state shown in FIG. 2 is reduced to an angle of inclination in a state shown in FIG. 3, and the stroke of the pistons 9 is reduced to accordingly reduce the discharge of the compressor.

Figure 3:
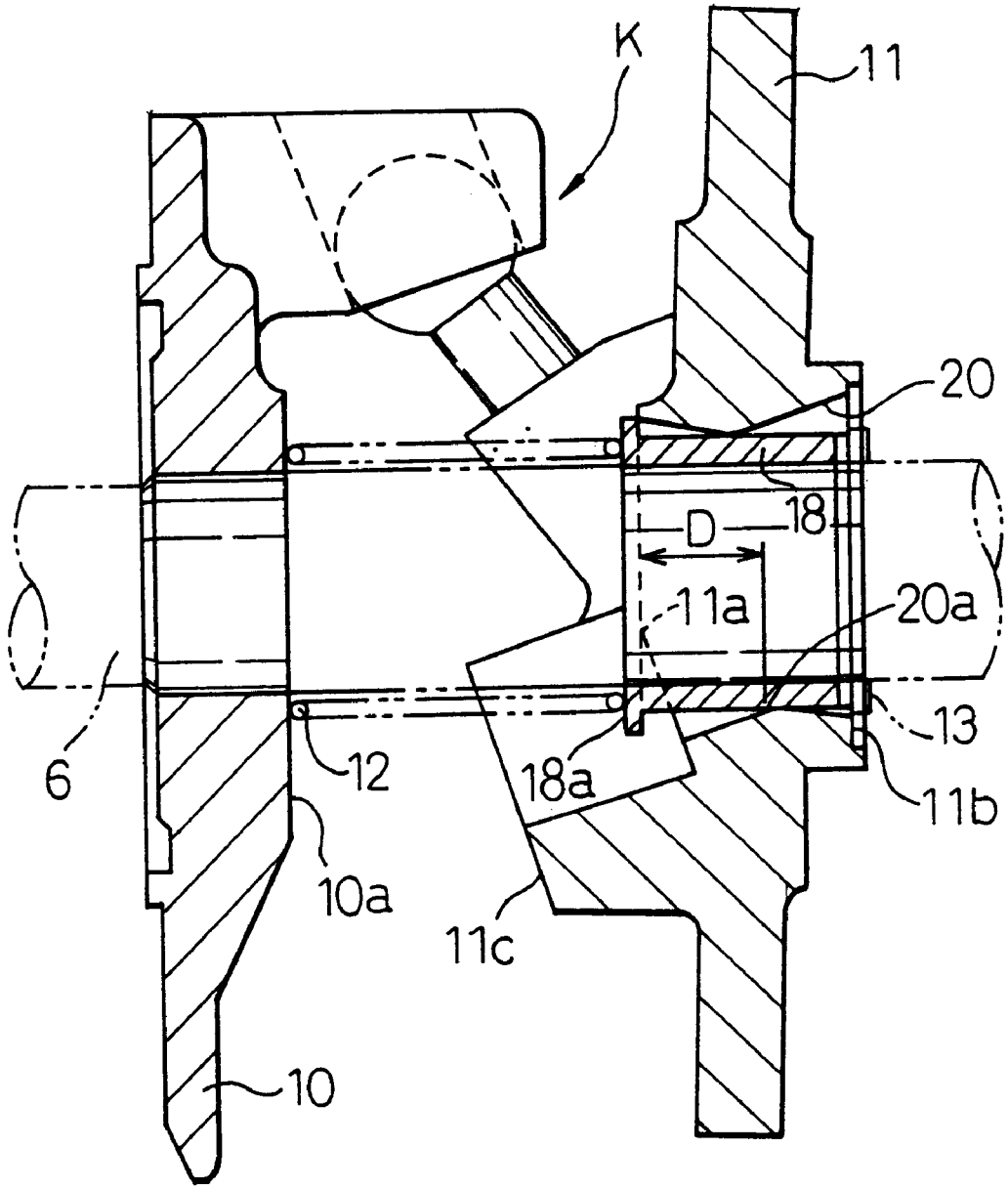
FIG. 3 is a cross-sectional view of the essential portion of the compressor of FIG. 1, illustrating a swash plate support means, in which a swash plate is set at a minimum inclination-angle position.

If the control valve is operated to decrease the pressure of the crank chamber 5 in the state shown in FIG. 3, the back pressure acting on the pistons 9 decreases and the inclination of the swash plate 11 increases. Consequently, the ball 16*a* of the guide pin 16 of the hinge mechanism K turns clockwise in the guide hole 17*a* and slides along the guide hole 17*a* away from the axis of the drive shaft 6, and the support portion 20*a* having the shape of a circular arc of the swash plate 11 turns on the sleeve 18 and moves parallel to the axis of the drive shaft 6. Thus, the inclination angle of the swash plate 11 in the state shown in FIG. 3 is increased to an inclination angle in a state shown in FIG. 2, and the stroke of the pistons 9 is increased and the discharge of the compressor increases accordingly.

The angle of inclination of the swash plate 11 is thus controlled by the operation of the control valve according to detected heat load on a refrigeration circuit. When the angle of inclination of the swash plate 11 varies, the support portion 20*a* in the through-bore 20 moves parallel to the axis while keeping contact with the sleeve 18, as mentioned above, and the sleeve 18 kept in contact with the swash plate 11 by the resilience of the coil spring 12 moves axially on the drive shaft 6, following the movement of the swash plate 11. Consequently, an actual distance by which the support portion 20*a* slides is a very small displacement of the support portion 20*a* relative to the sleeve 18 in abutment with the abutting portion 11*a*, i.e., the difference (D−d) between an axial distance D between the abutting portion 11*a* and the support portion 20*a* when the swash plate 11 is at the maximum inclination as shown in FIG. 2 and an axial distance d between the abutting portion 11*a* and the support portion 20*a* when the swash plate 11 is at the minimum inclination angle position as shown in FIG. 3. Therefore, the frictional abrasion of the sleeve 18 and the support portion 20*a* in sliding contact with the sleeve 18, and that of the drive shaft 6 in surface contact with the sleeve 18 can be effectively prevented, so that the smooth inclination varying action of the swash plate 11 can be ensured.

In the swash plate support means of this embodiment, the bottom surface of a counter bore 11*b* formed in the swash plate 11 at the rear end of the through-bore 20 comes into abutment with a snap ring 13 (FIG. 1) snapped on the drive shaft 6 to determine the minimum inclination of the swash plate 11 as best shown in FIG. 3.

A front end surface 11*c* formed in a lower portion of the swash plate 11 at an inclination to the front and the rear surface of the swash plate 11 comes into close contact with the rear end surface 10*a* of the rotor 10 to determine the maximum angle of inclination of the swash plate 11 as best shown in FIG. 2.

As mentioned above, the total angle of turning of the swash plate 11 relative to the sleeve 18 between a position corresponding to the minimum inclination angle and a position corresponding to the maximum inclination includes the margin angles $\theta_1$ and $\theta_2$. Particularly, the margin angle $\theta_1$ (10° through 15°) for the minimum angle of inclination greatly eases the work for inserting the ball 16*a* in the guide hole 17*a* when placing the swash plate 11 in the crank chamber 5 and contributes to the simplification of the assembling work.

The difference (D−d) can be reduced substantially to zero if the shape of the abutting portion 11*a* is designed so that the axial distance "D" between the abutting portion 11*a* of the swash plate 11, kept in contact with the flange 18*a* of the sleeve 18, and the support portion 20*a* of the swash plate 11 when the swash plate 11 is at the minimum angle of inclination as shown in FIG. 3 is approximately equal to the axial distance "d" between the same when the swash plate is at the maximum angle of inclination as shown in FIG. 2 by, for example, properly determining the inclination of the abutting portion 11*a* to the outer circumference of the swash plate 11 by calculation. If the difference (D−d) is substantially zero, the sliding movement of the support portion 20*a* relative to the sleeve 18 can be reduced to a negligible amount.

In the foregoing embodiment, the sleeve 18 is slidingly moved on the drive shaft 6 by the movement of the swash plate 11 in a range corresponding to the entire range of variation of the inclination of the swash plate 11. Nevertheless, the sliding movement of the sleeve 18 along the drive shaft 6 caused by the movement of the swash plate 11 toward the position corresponding to the minimum angle of inclination position may be limited by the snap ring 13 fixedly attached to the drive shaft 6, and the position of the swash plate 11 corresponding to the minimum angle of inclination may be determined by a suitable limiting part disposed between the cylinder block 1 and the swash plate 11, such as a projection projecting from the cylinder block 1.

The biasing means, i.e., the coil spring 12, for exerting a force to the sleeve 18 to make the sleeve 18 move in response to the turning movement of the swash plate 11 may be disposed on either the front side or the rear side of the sleeve 18. The coil spring 12 can be omitted by attaching a pair of snap rings to the front and the rear end portions of the sleeve 18 so as to be engaged with the front and the rear end, respectively, of the swash plate 11 in a manner such that the sleeve 18 moves on the drive shaft 6 in response to a change in the angle of inclination of the swash plate 11.

In the swash plate support means for the variable displacement swash plate type compressor shown in FIGS. 1 to 4, although a moment of a reaction force resulting from compression and acting to incline the swash plate is born by the sleeve in contact with the supporting portion of the swash plate, the sleeve moves axially on the drive shaft in response to the movement of the support portion of the swash plate as the angle of inclination of the swash plate changes and hence the substantial displacement of the support portion slides relative to the sleeve is reduced to a very short distance. Therefore, the frictional abrasion of the support portion and the sleeve, and the abrasion of the drive shaft by the sliding of the sleeve in surface-contact with the drive shaft can effectively be prevented, and the smooth change of the angle of inclination of the swash plate can surely be achieved.

In the compressor employing the single hinge mechanism, although a considerably large moment is produced about the pivotal axis Y about which the swash plate turns to change its inclination, and about the axis of the drive shaft 6 in a direction perpendicular to the axis of the drive shaft 6, the abrasion of the side edge of the swash plate and a portion of the sleeve in contact with the side edge of the swash plate can be prevented.

A variable displacement swash plate type compressor according to a second embodiment of the present invention will be described hereinafter with reference to FIGS. 5 through 10, in which parts like or corresponding to those shown in FIGS. 1 through 4 are designated by the same reference characters.

Figure 5:
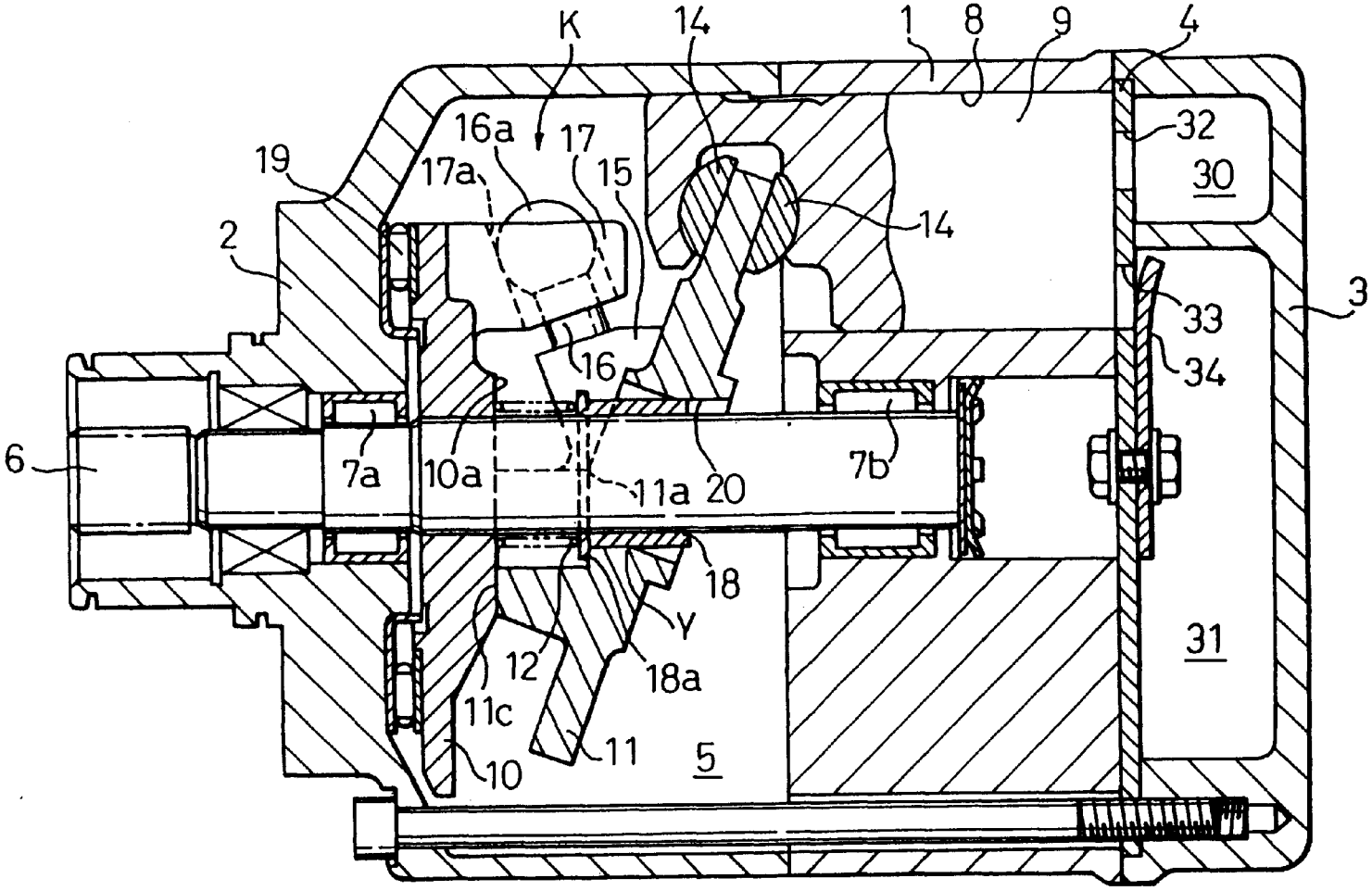
FIG. 5 is a general longitudinal sectional view of a variable displacement swash plate type compressor according to a second embodiment of the present invention.

Referring particularly to FIG. 5, the compressor of the second embodiment, excluding its swash plate support means, is substantially the same in construction as the compressor in the first embodiment shown in FIG. 1. Therefore, reference shall be made to the description of the internal mechanism of the foregoing compressor for the internal mechanism excluding the swash plate support means of the compressor of the second embodiment and the description of the internal mechanism excluding the swash plate support means of the compressor of the second embodiment will be omitted to avoid duplication.

The swash plate support means of the compressor of the second embodiment is not provided on a drive shaft 6 with any member corresponding to the snap ring 13 (FIG. 1) employed by the first embodiment to determine the minimum inclination of the swash plate 1. The shape of an elongate curved bore forming a through-bore 20 is different from that of the elongate curved bore of the first embodiment.

In the second embodiment, one inner surface of the through-bore 20 is formed so as to determine a minimum angle of inclination of a swash plate 11 in a high accuracy when the same inner surface is brought into contact with a sleeve 18. If a sleeve is pulled out, a large gap is formed between the inner surface of the through-bore 20 and a drive shaft. The large gap allows the inclination of a swash plate in the reverse direction necessary for coupling a hinge mechanism with the swash plate, which enables the swash plate 11 to be smoothly disposed in a crank chamber 5 when assembling the compressor.

Figure 8:
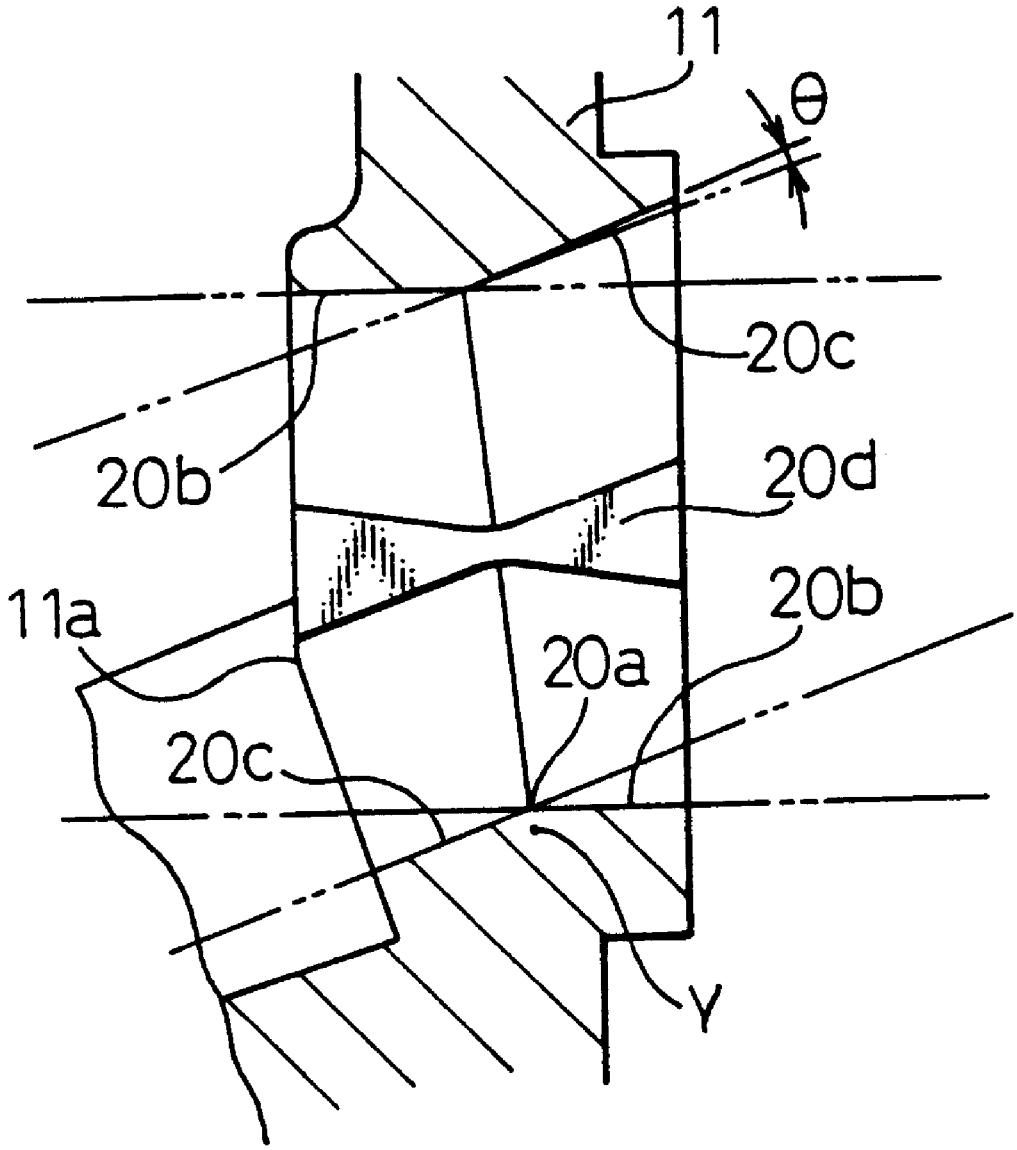
FIG. 8 is an enlarged cross-sectional view of an important internal construction of a swash plate shown in FIGS. 6 and 7.

Referring to FIGS. 5 and 8, the through-bore 20 of the swash plate 11 has the shape of an elongate curved bore which allows the swash plate 11 to turn about a pivotal axis "Y" extending in a swash plate region outside the sleeve 18 on a side opposite a hinge mechanism "K" with respect to the longitudinal axis of the drive shaft 6 to change its inclination in an entire controlled range.

As best shown in FIG. 8, the inner surface of the through-bore 20 is locally in contact with the outer circumference of the sleeve 18 to determine the radial position of the swash plate 11. More specifically, a support portion 20*a* having the shape of a small circular arc having its center on the pivotal axis "Y" is formed to determine the radial position of the swash plate 11 in a plane including the axis of the drive shaft 6 and the top dead center of the swash plate 11. An inner surface 20*b* of the curved through-bore 20 determines a minimum angle of inclination of the swash plate 11 when the same is brought into contact with the sleeve 18. An inner circumference 20*c* of the curved through-bore 20 is formed so that a relief angle θ is formed between the inner surface 20*c* of the bent through hole 20 and the sleeve 18 to avoid interference between the swash plate 11 and the sleeve 18 when the swash plate 11 is inclined at a maximum inclination with a contact surface formed in a lower portion of the front end of the swash plate 11 in contact with a rear surface

10*a* of a rotor 10. The through-bore 20, similarly to that of the first embodiment shown in FIGS. 1 to 4, has flat inner surfaces 20*d* created in opposite end portions thereof. The swash plate 11 of the second embodiment is not provided with any counter bore corresponding to the counter bore 11*b* formed in the rear end of the swash plate 11 of the first embodiment.

The sleeve 18 is provided at its front end with a flange 18*a*. A coil spring 12 is extended between the rotor 10 and the sleeve 18 to bias the sleeve 18 elastically rearward to keep the flange 18*a* in contact with an abutting portion 11*a* of the front end surface of the swash plate 11, so that the sleeve 18 is shifted on the drive shaft 6 in response to a change in an angle of inclination of the swash plate 11.

A bracket 15, i.e., one of the components of the hinge mechanism K, projects from the front surface of the swash plate 11. A guide pin 16 has a base end fixed to the bracket 15 and a free end provided with a ball 16*a*.

A support arm 17, i.e., another component of the hinge mechanism K, projects parallel to the axis of the drive shaft 6 from an upper portion of the rear surface of the rotor 10 so as to lie opposite to the guide pin 16. A guide hole 17*a* is formed through a free end portion of the support arm 17 so as to extend obliquely rearward and toward the axis of the drive shaft 6 parallel to a plane defined by the axis of the drive shaft 6 and the top dead center of the swash plate 11. The center axis of the thus inclined guide hole 17*a* is determined so that the top dead center of each piston 9 does not change while the angle of inclination of the swash plate restrained from free movement by the ball 16*a* fitted in the guide hole 17*a* is varying.

The variable displacement swash plate type compressor thus constructed starts its refrigerant compressing operation when the drive shaft 6 is driven for rotation by an external force. The swash plate 11 is rotated together with the drive shaft 6 by the rotor 10 and, therefore, the pistons 9 are driven for reciprocation in corresponding cylinder bores 8 through shoes 14 to suck a refrigerant gas from a suction chamber 30 into a compression chamber, to compress the refrigerant gas and to discharge the compressed refrigerant gas into a discharge chamber 31. The discharge of the refrigerant gas discharged into the discharge chamber 31 is controlled by regulating the pressure of a crank chamber 5 by a control valve.

Figure 6:
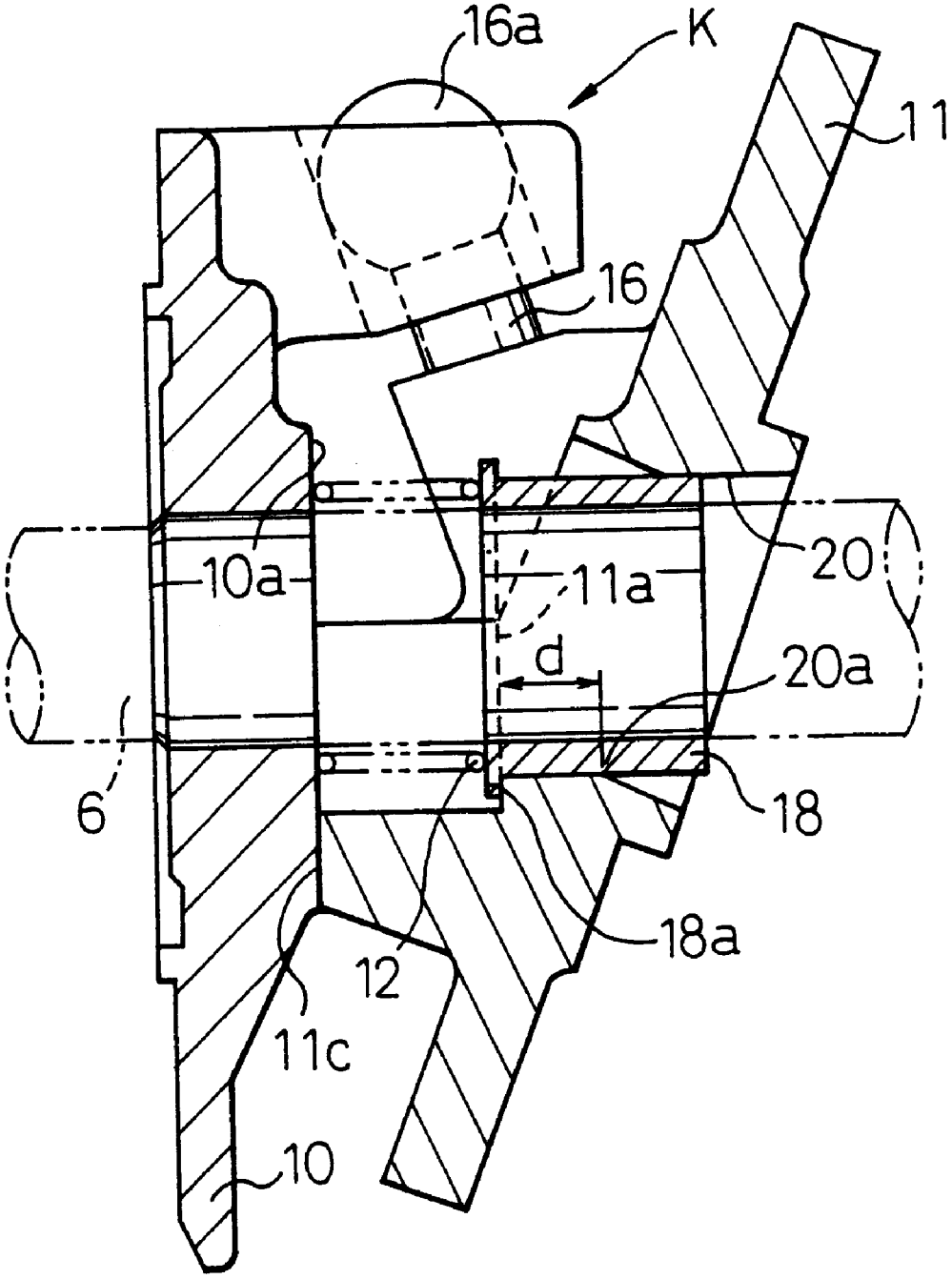
FIG. 6 is a view, similar to FIG. 2, of an essential portion of the compressor of FIG. 5, illustrating a swash plate support means, in which a swash plate is set at a maximum inclination-angle position.

If the control valve is operated to increase the pressure of the crank chamber 5 in a state shown in FIG. 6, a back pressure acting on the pistons 9 increases, and the angle of inclination of the swash plate 11 decreases. Thus, the ball 16*a* of the guide pin 16 of the hinge mechanism K turns counterclockwise in the guide hole 17*a* and slides along the guide hole 17*a* toward the axis of the drive shaft 6, and the support portion 20*a* having the shape of a circular arc of the swash plate 11 turns about the pivotal axis Y on the sleeve 18, i.e., a component of the swash plate support means, and moves rearward in parallel to the axis of the drive shaft 6. Thus, the inclination of the swash plate 11 in the state shown in FIG. 6 is reduced to an inclination in a state shown in FIG. 7, the stroke of the pistons 9 is reduced, and the discharge of the compressor is reduced accordingly.

Figure 7:
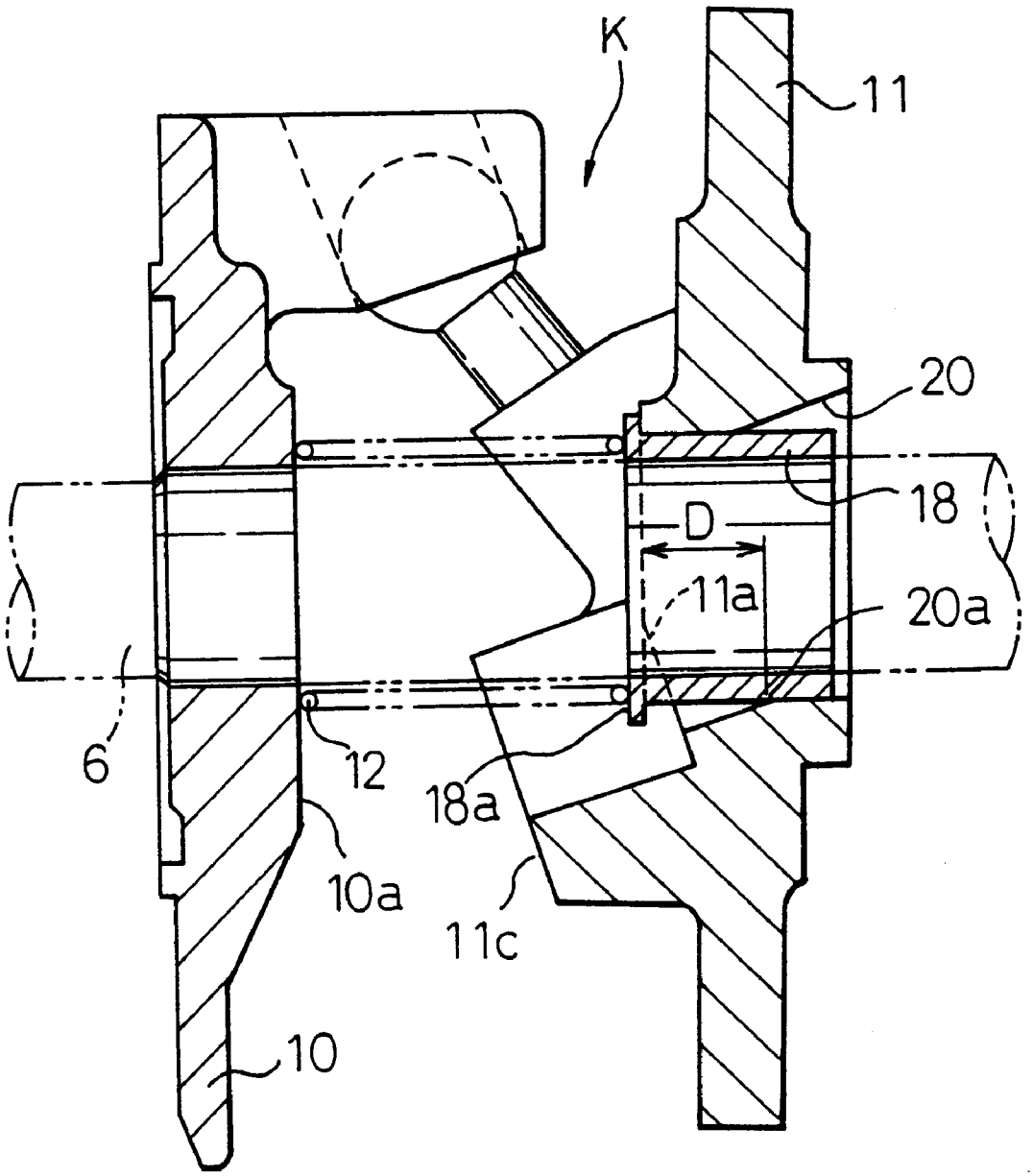
FIG. 7 is a view, similar to FIG. 3, of an essential portion of the compressor of FIG. 5, illustrating a swash plate support means, in which a swash plate is set at a minimum inclination-angle position.

If the control valve is operated to reduce a pressure prevailing in the crank chamber 5 in the state shown in FIG. 7, the back pressure acting on the pistons 9 decreases and the angle of inclination of the swash plate 11 increases. Therefore, the ball 16*a* of the guide pin 16 of the hinge mechanism "K" turns clockwise in the guide hole 17*a* and slides along the guide hole 17*a* away from the axis of the drive shaft 6, and the support portion 20*a* having the shape of a circular arc of the swash plate 11 turns on the sleeve 18 and moves in parallel to the axis of the drive shaft 6. Thus, the angle of inclination of the swash plate 11 in the state shown in FIG. 7 is increased to an angle of inclination in a state shown in FIG. 6, the stroke of the pistons 9 is increased, and the discharge capacity of the compressor in turn increases.

The angle of inclination of the swash plate 11 is thus controlled by the operation of the control valve according to detected heat load on a refrigeration circuit. When the inclination of the swash plate 11 varies, the support portion 20*a* in the through-bore 20 moves parallel to the axis keeping contact with the sleeve 18 as mentioned above, and the sleeve 18 kept in contact with the swash plate 11 by the resilience of the coil spring 12 moves axially on the drive shaft 6, following the movement of the swash plate 11. Consequently, an actual distance by which the support portion 20*a* slides is a very small displacement of the support portion 20*a* relative to the sleeve 18 in abutment with the abutting portion 11*a*, i.e., the difference (D−d) between an axial distance D between the abutting portion 11*a* and the support portion 20*a* when the swash plate 11 is at the minimum angle of inclination as shown in FIG. 7 and an axial distance d between the abutting portion 11*a* and the support portion 20*a* when the swash plate 11 is at the maximum angle of inclination as shown in FIG. 6. Therefore, the frictional abrasion of the sleeve 18 and the support portion 20*a* in sliding contact with the sleeve 18, and that of the drive shaft 6 in surface-contact with the sleeve 18 can effectively be prevented, so that the smooth inclination varying action of the swash plate 11 can be ensured.

Figure 10:
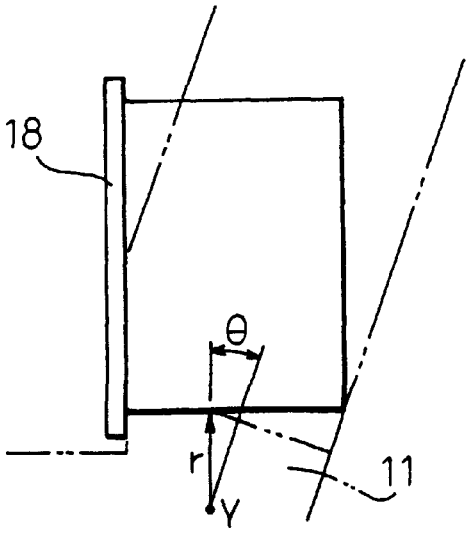
FIG. 10 is a diagrammatic view of assistance in explaining the displacement of a support portion formed in the swash plate, relative to a sleeve in the compressor of FIG. 5.
Figure 11:
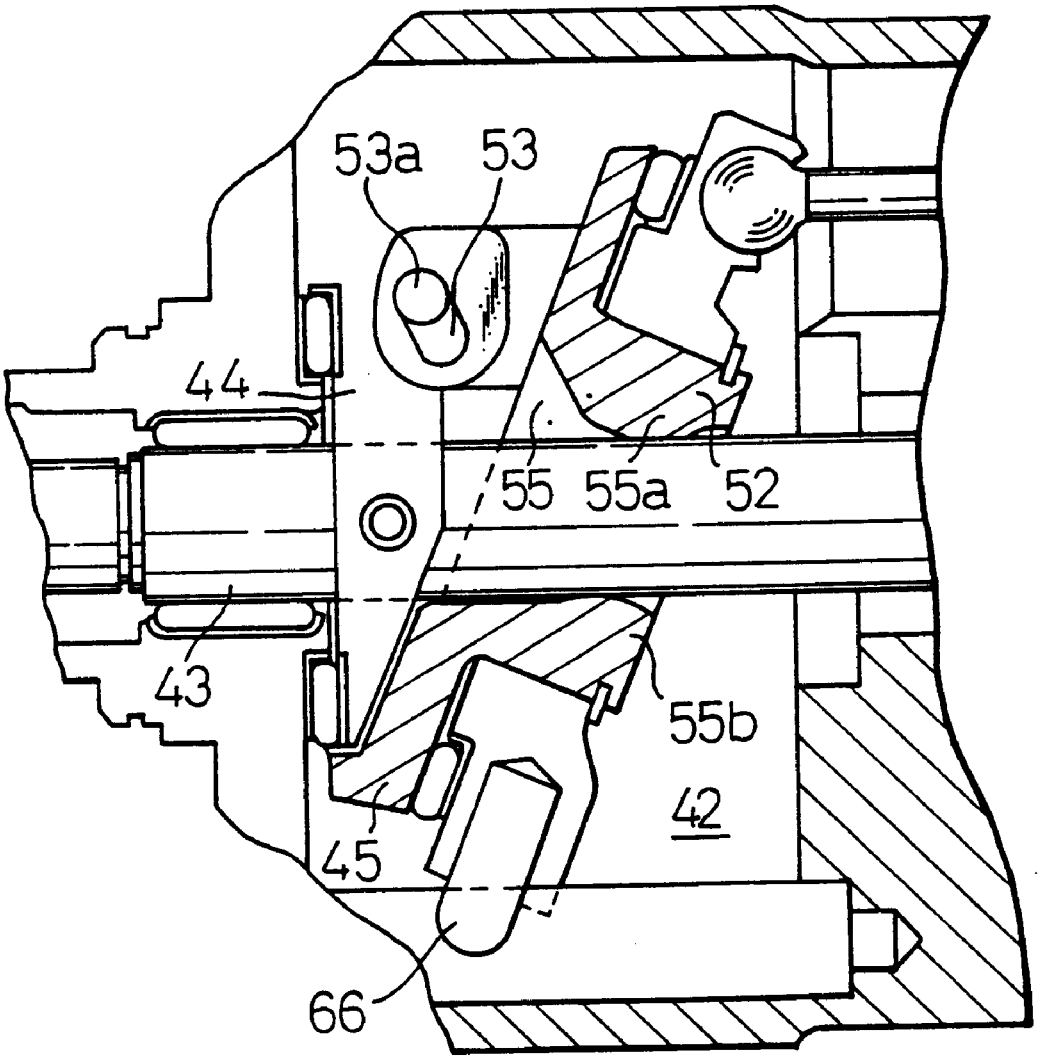
Fig.11 (PRIOR ART)
FIG. 11 is a cross-sectional view of a swash plate support means incorporated in one of the prior art variable displacement swash plate type compressors.

The distance by which the support portion 20*a* slides relative to the sleeve 18 can be reduced to a substantially negligible extent if the abutting portion 11*a* is designed in a shape to make the axial distance "D" between the abutting portion 11*a* and the support portion 20*a* in a state shown in FIG. 7 where the swash plate 11 inclination is approximately equal to the axial distance "d" between the abutting portion 11*a* and the support portion 20*a* in a state shown in FIG. 6 where the swash plate 11 is at the maximum inclination, or if the length rθ of an arc of a circle having its center on the pivotal axis Y as shown in FIG. 10 is equal to the difference (D−d).

It is very important, in view of holding the swash plate 11 at the minimum inclination with high accuracy, that the swash plate 11 is positioned at the position corresponding to the minimum inclination angle, which determines the minimum discharge displacement of the compressor, by the abutment of the inner surface 20*b* of the through-bore 20 having the shape of an elongate curved bore with the outer circumference of the sleeve 18. That is, the accuracy of the minimum inclination is dependent on only two factors, i.e., the accuracy of an angle between an effective plane of the swash plate 11, i.e., the outer circumferential plane of the swash plate 11 associated through shoes 14 with the pistons 9, and the inner surface 20*b*, and a clearance between the outer circumference of the drive shaft 6 and the inner circumference of the sleeve 18 put on the drive shaft 6. In the compressor of the present invention, the minimum angle of inclination of the swash plate is not affected by the complicated combined effect of tolerances in the dimensions of many components including the rotor 10, the hinge mechanism K and the snap ring snapped on the drive shaft 6 and permissible deviations of those components from correct positions and, consequently, machining work for making the components and assembling work for assembling the compressor of the second embodiment can be simplified.

It is worthy of notice that the sleeve 18 interposed between the through-bore 20 of the swash plate 11, and the drive shaft 6 as means for preventing the abrasion of the surface defining the through-bore 20 and the drive shaft 6 plays an important and effective role in coupling the component of a hinge mechanism K, i.e., the support arm 17 formed integrally with the rotor 10, and the bracket 15 formed integrally with the swash plate 11, with the guide pin 16.

Figure 9:
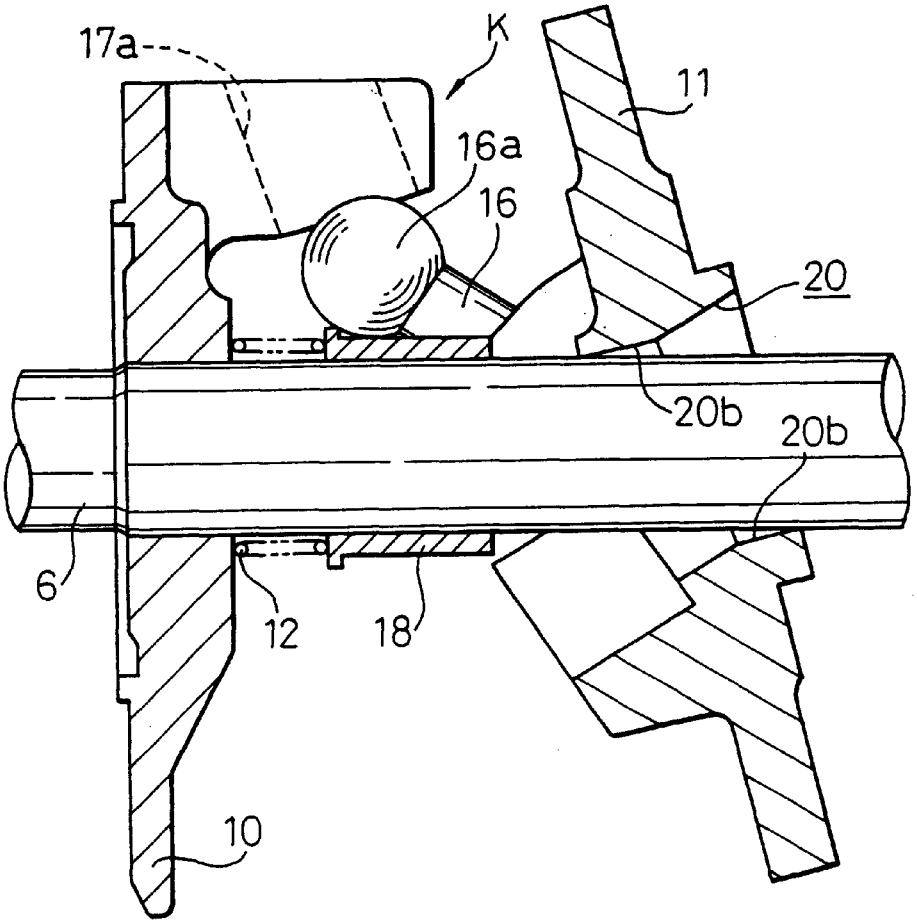
FIG. 9 is a cross-sectional view of an essential portion of the compressor of FIG. 5, of assistance in explaining an assembling procedure for assembling a hinge mechanism incorporated in the swash plate support means.

It can be seen from FIG. 9 that the swash plate 11 must be turned in a reverse direction, i.e., a direction opposite a direction in which the swash plate 11 normally is inclined, beyond a position corresponding to an inclination of 0° when inserting the ball 16*a* of the guide pin 16 into the guide hole 17*a* of the support arm 17 of the hinge mechanism K so that the guide pin 16 approaches the outer circumference of the drive shaft 6.

FIG. 9 shows a state immediately before the guide pin 16 is inserted into the guide hole 17*a,* in which the sleeve 18 is pulled toward the rotor 10 out of its working position to secure a large space corresponding to the volume of the sleeve 18 between the through-bore 20 and the drive shaft 6. Particularly, a large space between the inner surface 20*b* and the drive shaft 6 enables the inclination in the reverse direction of the swash plate 11 necessary for inserting the guide pin 16 into the guide hole 17*a.*

The coil spring 12 for applying a resilient force to the sleeve 18 to make the sleeve 18 follow the movement of the swash plate 11 for changing the inclination may be disposed on either the front side or the rear side of the sleeve 18. If the coil spring 12 is extended between the rotor 10 and the sleeve 18 as shown in FIG. 5, the sleeve 18 can be very smoothly pushed into the through-bore 20 by the resilience of the coil spring 12 when the sleeve, pulled out of and retained at a position outside its working position, is released after the completion of coupling of the bracket 15 and the support arm 17 of the hinge mechanism K.

Although a connecting arrangement of the hinge mechanism K of the second embodiment is formed by the direct engagement of the ball 16*a* of the guide pin 16 and the guide hole 17, the connecting arrangement may include, for example, a bushing and shoes interposed between the ball 16*a* and the guide hole 17, provided that the guide pin is able to move smoothly with satisfactory accuracy when the inclination of the swash plate supported by the swash plate support means including the sleeve 18 varies.

The arrangement for positioning the swash plate 11 at the maximum inclination need not necessarily be limited to the foregoing arrangement which positions the swash plate 11 at the maximum angle of inclination by the abutment of a front end surface 11*c* of the swash plate 11 with the rear surface 10*a* of the rotor 10. The relief angle θ between the inner surface 20*c* of the bent through-bore 20 and the sleeve 18 may be reduced to zero, and the swash plate 11 may be positioned at the maximum angle of inclination, similarly to being positioned at the minimum inclination, by bringing the inner surface 20*c* into contact with the sleeve 18.

As is apparent from the foregoing description, the swash plate support means of the variable displacement swash plate compressor in the second embodiment, similarly to that of the variable displacement swash plate compressor in the first embodiment, ensures the smooth inclination changing operation of the swash plate, prevents the abrasion of the components including the swash plate, the sleeve and the drive shaft effectively, and provides the following additional advantages.

Since the swash plate is positioned at the minimum angle of inclination by the abutment of the inner surface of the elongate curved bore forming the through-bore with the sleeve, only a very small number of factors participate in determining the accuracy of the minimum inclination angle. Therefore, the minimum inclination can be determined with high accuracy and, consequently, a highly accurate minimum discharge capacity of the compressor can be ensured.

The space secured between the through-bore and the drive shaft by pulling out the sleeve from the through-bore of the swash plate enables the inclination of the swash plate in the reverse direction necessary for connecting the swash plate to the hinge mechanism when disposing the swash plate in the crank chamber. Therefore, both the determination of the minimum angle of inclination of the swash plate by the through-bore and the inclination of the swash plate in the reverse direction necessary when assembling the compressor can easily be achieved.

Although the invention has been described in connection with the description of the two embodiments, it should be understood by those skilled in the art that many variations and modifications are possible therein without departing from the technical scope of the present invention as set forth in the appended claims.

We claim:

1. A variable displacement swash plate type compressor comprising:

a cylinder block provided with a plurality of parallel cylinder bores, and serving as an outer framework of the compressor;

a front housing defining therein a crank chamber, and sealingly connected to said cylinder block so as to close an open front end of said cylinder block;

a drive shaft rotatably supported by said cylinder block and said front housing having an axis thereof about which said drive shaft is rotated;

a rotor fixedly mounted on said drive shaft within said crank chamber defined by said front housing;

a rear housing having a suction chamber and a discharge chamber formed therein, and sealingly connected to said cylinder block so as to close an open rear end of said cylinder block;

a swash plate mounted on said drive shaft so that the angle of inclination thereof can be changed, and operatively engaged with said rotor via a hinge means; and pistons fitted for linear motions in said cylinder bores and engaged with said swash plate;

wherein said swash plate has a through-bore formed therein, a sleeve member arranged between an inner wall of said through-bore and said drive shaft so as to axially move on said drive shaft in response to a change in the angle of inclination of said swash plate, and pressed against said swash plate by the resilience of a spring extended between said rotor and said sleeve member, said swash plate including a support portion thereof formed in an inner surface defining said through-bore at a portion thereof which is located opposite to said hinge means with respect to the axis of said drive shaft, the support portion of said swash plate being capable of coming into local contact with said sleeve member, and the angle of inclination of said swash plate supported by the support portion being able to be changed in a controlled range.

2. The variable displacement swash plate type compressor according to claim 1, wherein said through-bore of said swash plate includes two continuous bore sections extending on the axially opposite sides of said support portion, allowing movement of said swash plate for changing the angle of inclination thereof, and defined by two different inner surfaces.

3. The variable displacement swash plate type compressor according to claim 2, wherein said swash plate is provided with a counter bore near one of said two bore sections forming said through-bore, a bottom surface of said counter bore coming into contact with a stopping member attached to said drive shaft to determine a position of said swash plate where said swash plate is inclined at a minimum angle of inclination.

4. The variable displacement swash plate type compressor according to claim 2, wherein said two continuous bore sections of said through-bore of said swash plate are curved relative to each other.

5. The variable displacement swash plate type compressor according to claim 1, wherein said sleeve member moves in parallel to the axis of said drive shaft on said drive shaft in response to a movement of said swash plate in the entire range of angle of inclination thereof.

6. The variable displacement swash plate type compressor according to any one of claim 1, wherein said sleeve member is pressed against said swash plate by the resilience of a spring.

7. The variable displacement swash plate type compressor according to any one of claim 1, wherein said swash plate is provided with an abutting portion to be brought into contact with a flange formed on said sleeve member, formed near one end of said through-bore, and said abutting portion is formed in a shape such that the axial distance between said support portion and said abutting portion remains substantially unchanged regardless of the inclination of said swash plate.

8. The variable displacement swash plate type compressor according to claim 2, wherein one of said two different inner surfaces defining said two bore sections of said through-bore is brought into contact with said sleeve member to determine the minimum angle of inclination of said swash plate.

9. The variable displacement swash plate type compressor according to claim 8, wherein a large space is secured between said two different inner surfaces defining said two bore sections of said through-bore of said swash plate and said drive shaft, when said sleeve member is extracted from said through-bore to thereby ease assembly work for assembling said hinge means disposed between said rotor and said swash plate.

* * * * *